US009683376B2

(12) United States Patent
Zahner et al.

(10) Patent No.: US 9,683,376 B2
(45) Date of Patent: Jun. 20, 2017

(54) REMOVABLE AND REPLACEABLE COVER FOR A WINDOW SUPPORT OF A CURTAIN WALL

(71) Applicant: A. ZAHNER COMPANY, Kansas City, MO (US)

(72) Inventors: L. William Zahner, Kansas City, MO (US); Craig Long, Lawrence, KS (US); Randy Stratman, Prairie Village, KS (US)

(73) Assignee: A. ZAHNER COMPANY, Kansas City, MO (US)

( * ) Notice: Subject to any disclaimer, the term of this patent is extended or adjusted under 35 U.S.C. 154(b) by 0 days.

(21) Appl. No.: 14/839,507

(22) Filed: Aug. 28, 2015

(65) Prior Publication Data

US 2017/0058538 A1 Mar. 2, 2017

(51) Int. Cl.

| | |
|---|---|
| ***E04B 2/88*** | (2006.01) |
| ***E04B 2/96*** | (2006.01) |
| ***E04F 19/02*** | (2006.01) |

(52) U.S. Cl.

CPC ..... *E04F 19/02* (2013.01); *E04B 2/88* (2013.01); *E04B 2/967* (2013.01); *E04B 2/96* (2013.01)

(58) Field of Classification Search

None

See application file for complete search history.

(56) References Cited

U.S. PATENT DOCUMENTS

| | | | | |
|---|---|---|---|---|
| 2,866,527 | A * | 12/1958 | Schilling | E04B 2/967 52/235 |
| 3,071,215 | A * | 1/1963 | Gall | E04B 2/96 52/204.69 |
| 3,218,768 | A * | 11/1965 | Engholm | E04B 2/96 52/235 |
| 3,251,168 | A | 5/1966 | Fream et al. | |
| 3,367,077 | A * | 2/1968 | Johnston | E04B 2/96 52/204.591 |
| 3,690,079 | A * | 9/1972 | Hemminger | E04B 2/965 428/573 |
| 3,736,717 | A * | 6/1973 | Farley | E04B 2/96 52/235 |
| 3,798,862 | A * | 3/1974 | Stoakes | E04B 2/965 52/204.591 |
| 3,868,804 | A * | 3/1975 | Tantlinger | E06B 3/68 52/206 |
| 4,120,127 | A | 10/1978 | Hubbard | |
| 4,276,729 | A * | 7/1981 | Shiga | E04B 2/88 52/209 |
| 4,428,171 | A * | 1/1984 | Harbin | E04B 2/965 49/DIG. 1 |
| RE31,955 | E * | 7/1985 | Shiga | E04B 2/88 52/209 |

(Continued)

*Primary Examiner* — Joshua J Michener
*Assistant Examiner* — Kyle Walraed-Sullivan
(74) *Attorney, Agent, or Firm* — Hovey Williams LLP

(57) ABSTRACT

A substantially vertically extending removable and replaceable cover and a substantially horizontally extending cover for use with a curtain wall system broadly comprising an array of windows, a set of vertical and horizontal mullions, a set of window gaskets. The covers overlay the mullions and each include a front side, left and right or top and bottom sides, and rear tabs extending therefrom for removably connecting the covers on the mullions.

13 Claims, 8 Drawing Sheets

(56) References Cited

U.S. PATENT DOCUMENTS 4,535,833 A * 8/1985 Gartner ..... E04B 2/96 165/53
4,557,537 A * 12/1985 Greer ..... H01R 4/64 29/256
4,584,804 A * 4/1986 Tajima ..... E04B 2/7863 52/209
4,608,793 A * 9/1986 Yost ..... E06B 7/14 52/204.597
4,650,702 A * 3/1987 Whitmyer ..... E06B 3/5427 428/31
4,672,784 A * 6/1987 Pohlar ..... E04B 2/96 52/209
4,691,489 A * 9/1987 Shea, Jr. ..... E06B 3/5427 52/204.593
4,750,310 A * 6/1988 Holcombe ..... E06B 1/38 403/348
4,756,132 A * 7/1988 Newman ..... E04B 2/965 52/235
4,858,386 A * 8/1989 Nail ..... E06B 1/524 49/505
4,903,454 A * 2/1990 Rose ..... E04B 2/96 52/235
5,355,645 A * 10/1994 Farag ..... E06B 3/5427 52/235
5,579,616 A * 12/1996 Farag ..... E06B 3/5427 52/204.5
5,592,795 A * 1/1997 Rinehart ..... E04B 2/967 52/204.591
6,438,913 B1 * 8/2002 Ishikawa ..... E04B 2/96 403/321
6,735,912 B2 * 5/2004 Riggio ..... E04D 3/08 52/235
7,111,433 B2 9/2006 Kerscher
7,594,364 B2 * 9/2009 Rinehart ..... B32B 17/10036 52/204.593
2003/0226324 A1 * 12/2003 Hogan ..... E04B 2/96 52/235
2005/0188631 A1 * 9/2005 Neal ..... E06B 5/106 52/204.5
2006/0201084 A1 * 9/2006 Arias ..... E04B 2/965 52/235
2007/0195535 A1 * 8/2007 Artwohl ..... A47F 3/001 362/341
2008/0073036 A1 * 3/2008 Braunstein ..... E04B 2/96 160/45
2008/0245001 A1 10/2008 Alkoury et al.
2010/0207542 A1 * 8/2010 Harwood ..... F21S 2/00 315/294
2010/0282137 A1 * 11/2010 Neal ..... E06B 3/68 109/77
2010/0293882 A1 * 11/2010 Labrecque ..... E04B 2/967 52/705
2011/0113706 A1 * 5/2011 Krause ..... F41H 5/263 52/204.5
2012/0272605 A1 * 11/2012 Huang ..... E04B 2/96 52/483.1
2013/0221303 A1 * 8/2013 Ash ..... E04H 17/1413 256/65.12
2014/0166908 A1 * 6/2014 Boissevain ..... F21V 23/0471 250/504 R

* cited by examiner

REMOVABLE AND REPLACEABLE COVER FOR A WINDOW SUPPORT OF A CURTAIN WALL

BACKGROUND

The present invention relates to outer covers for overlaying mullions of a curtain wall system.

A curtain wall is a non-structural outer covering of a building designed to keep weather out of the building and to let light into the building. Curtain walls can also make the exterior of the building look aesthetically pleasing. A conventional curtain wall system generally includes a set of mullions or other frame-like supports in-filled with glass windows. The mullions are typically aluminum extrusions connected together with internal shear blocks and are anodized with a clear, dark bronze, or black aluminum oxide or are coated with a layer of paint. Some people desire curtain wall mullions made of materials other than aluminum. However, many materials cannot be extruded as easily as aluminum, so when it is desired to use different materials, they are either welded, press braked into shapes, or a decorative covering is placed over the aluminum mullion via adhesives, pressure lamination, or fasteners.

Unfortunately, conventional mullion covers are not easily removable and replaceable. If the covers become dented or scratched, additional covers must be overlayed on top of them, which looks undesirable, or the curtain wall must be disassembled to replace the covers. In addition, the aesthetic design of the curtain wall system cannot be changed unless other coverings are overlayed on top of the original covers or the curtain wall is disassembled and the covers are replaced. Moreover, the aesthetic designs of the covers are limited in complexity to the manufacturing techniques used to make the underlying mullions or to the adhesives and fasteners of the covers.

Accordingly, there is a need for an improved mullion cover that overcomes the above-described limitations.

SUMMARY

The present invention solves the above-described problems and provides a distinct advance in the art of outer covers for curtain wall systems. More particularly, the present invention provides a set of removable, replaceable, and interchangeable metal covers for a curtain wall.

The removable covers overlay mullions of the curtain wall and each include a front side, left and right or top and bottom sides, and rear tabs extending therefrom. The sides and tabs of each removable cover cooperatively form an interior chamber for receiving a mullion therein. The front sides of the removable covers include a three-dimensional or etched design or may be rounded or have blade-like edges. The shape of each removable cover is limited only by the ability to shape thin metal.

The removable covers may be formed of any materials but are preferably formed of a thin, tight-fitting skin of zinc, copper, steel, stainless steel, brass, bronze, titanium, etched aluminum, plated metal, or coated metal.

The removable covers do not require any fasteners or adhesives and may be installed onto or removed from a mullion by slightly bending the sides outward until the rear tabs of the removable covers may be slid over the mullion. The removable covers may be replaced with other removable covers having different designs on the front sides.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
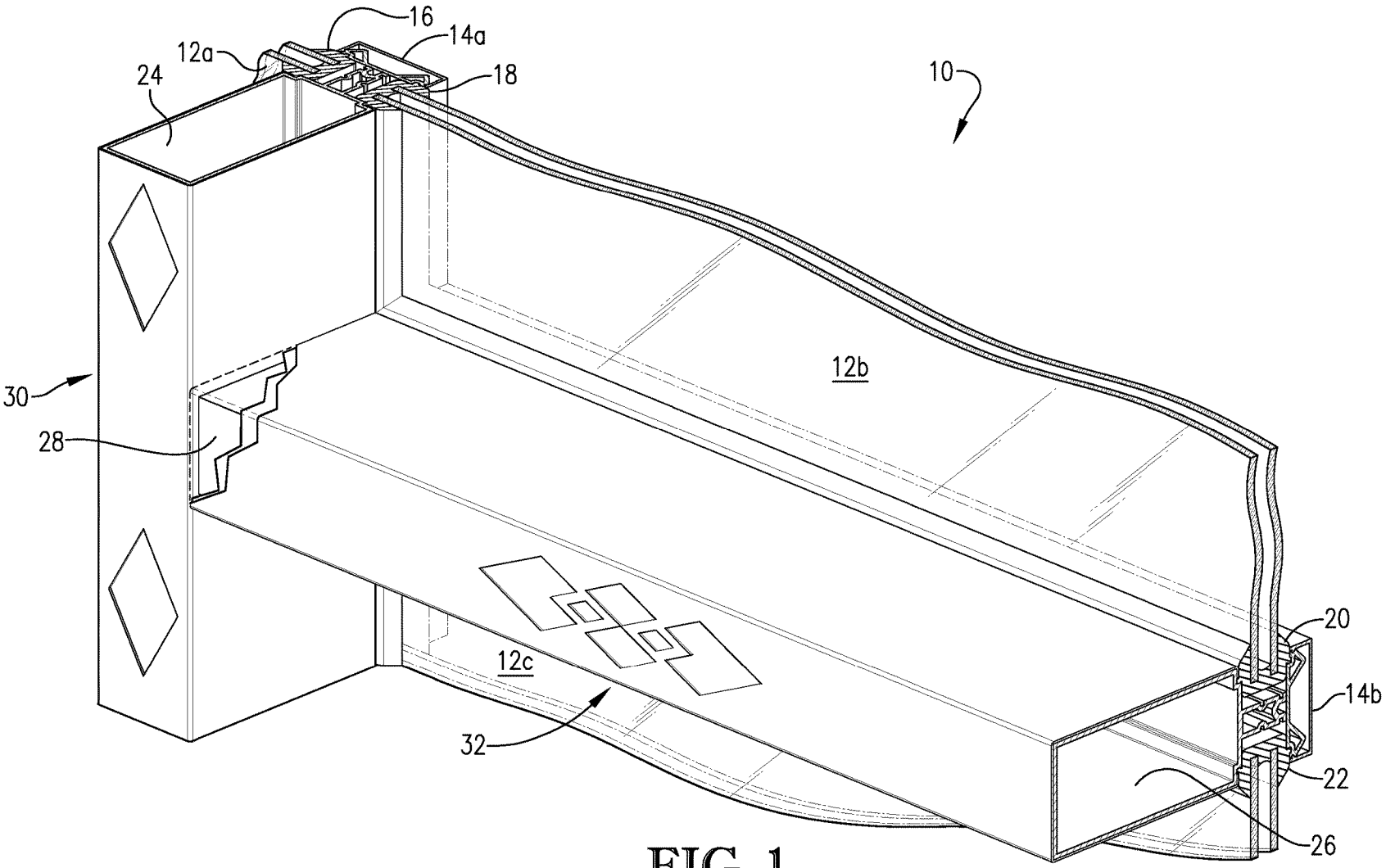
FIG. 1 is a fragmentary partial perspective view of a curtain wall system on which the removable covering of the present invention may be installed.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
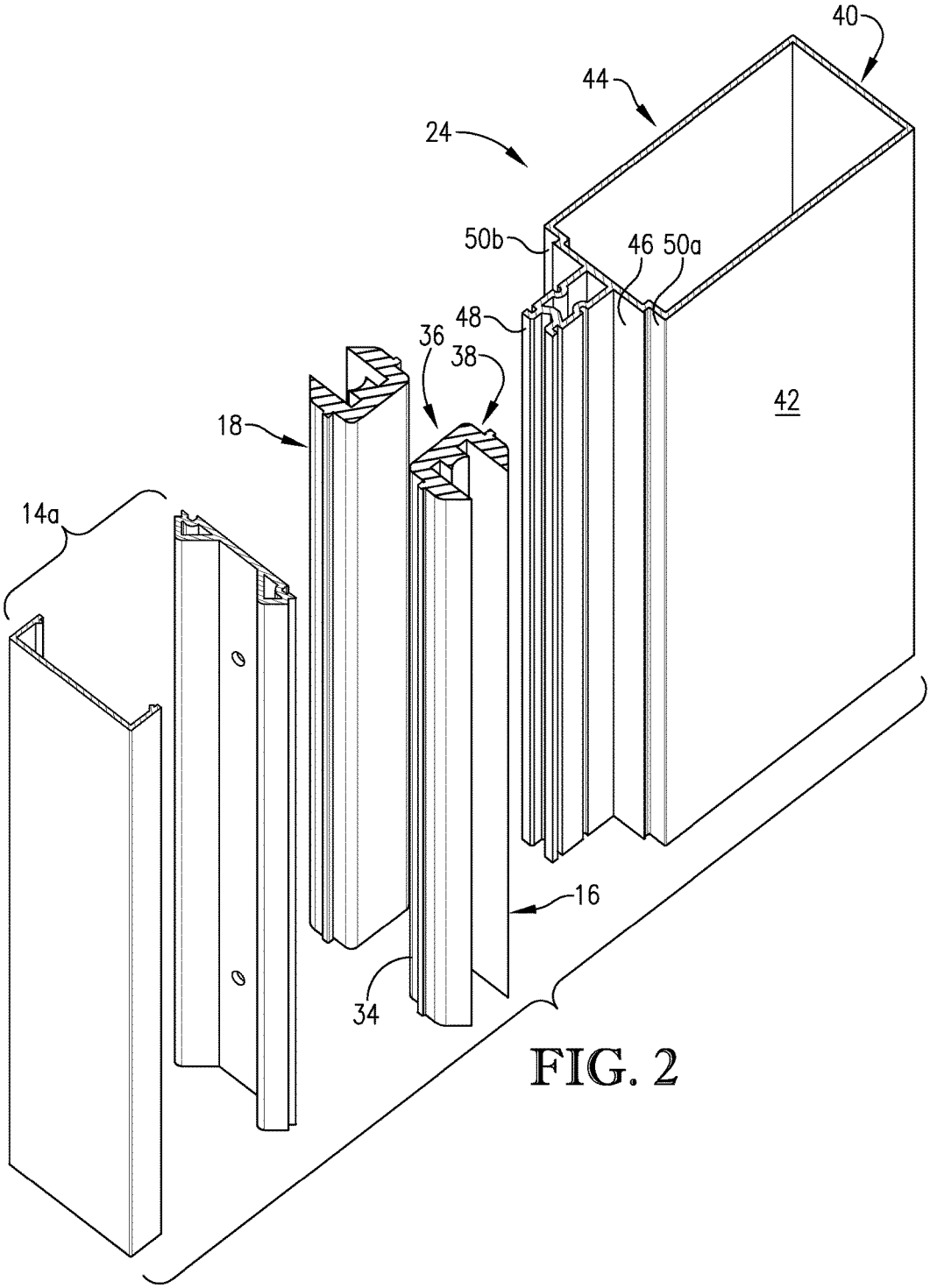
FIG. 2 is an exploded view of a vertical mullion and vertical window gaskets of the curtain wall system of FIG. 1.
Figure 3:
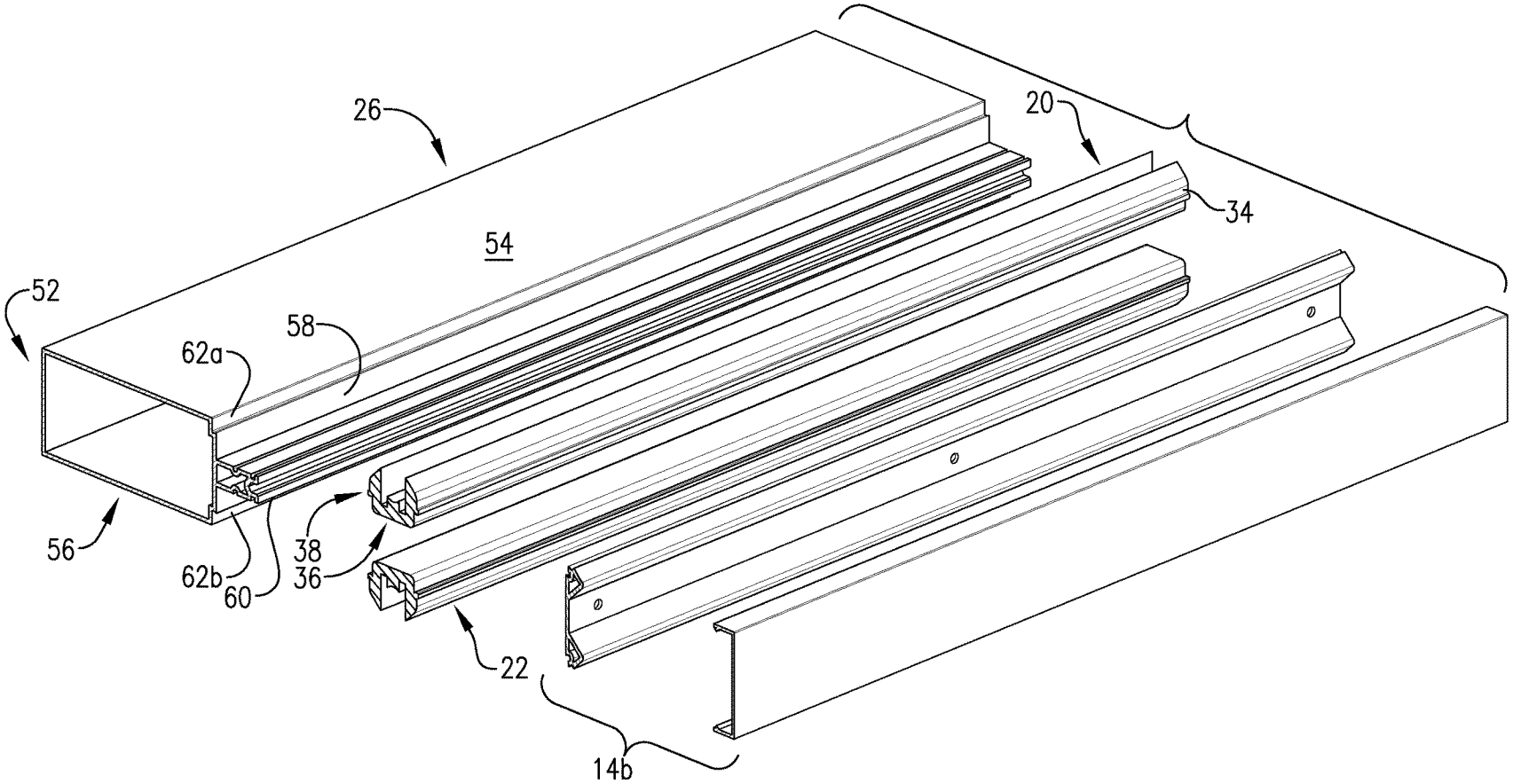
FIG. 3 is an exploded view of a horizontal mullion and vertical window gaskets of the curtain wall system of FIG. 1.

Turning now to the drawing figures, and particularly FIGS. 1-3, an exemplary curtain wall system 10 on which the removable covers of the present invention may be installed is illustrated. The curtain wall system 10 broadly comprises a set of windows 12*a-c*, a set of vertical and horizontal window struts 14*a,b*, a set of window gaskets 16, 18, 20, and 22, a vertical mullion 24, a horizontal mullion 26 (e.g., a transom), and a shear block 28.

The windows 12*a-c* are provided for keeping natural weather elements out of a building while letting sunlight into the building and for creating an overall aesthetic of the building. The windows 12*a-c* are typically arranged in a rectangular array but may be arranged in any fashion. The windows 12*a-c* may be single pane, double pane, triple pane, or greater, and typically have top, bottom, left, and right edges.

The vertical and horizontal window struts 14*a,b* provide structural integrity to the curtain wall system 10 and are typically formed of extruded aluminum or other suitable material. The window struts 14*a,b* are positioned between edges of the windows 12*a-c* and include fasteners for connecting the mullions 24, 26 thereto.

The vertical window gaskets 16, 18 and the horizontal window gaskets 20, 22 are provided for forming an airtight seal around the edges of the windows 12*a-c* and are formed of rubber, caulk, glue, or any other suitable material. The vertical window gaskets 16, 18 each include a first side 30 configured to abut the vertical window strut 14*a*, a second side 32 configured to abut or face a rail of the vertical mullion 24, and a third side 34 configured to abut a rear side of the vertical mullion 24, as shown in FIG. 2. The horizontal window gaskets 20, 22 each include a first side 30 configured to abut the window strut 14*b*, a second side 32 configured to abut a rail of the horizontal mullion 26, and a third side 34 configured to abut a rear side of the vertical mullion 26, as shown in FIG. 3. The third sides 34 of the window gaskets 16, 18, 20, and 22 may include a contour or recess configured to receive a tab of one of the removable covers therein.

The vertical mullion 24 is provided for adding structural rigidity and for giving aesthetic shape to the curtain wall system 10 and may be positioned between the windows 12*a,b*, as shown in FIG. 1. The vertical mullion 24 may be formed of extruded aluminum or other suitable material such as steel or composite and has a height of approximately 24 inches or any suitable height. The vertical mullion 24 includes a front wall 36, a left and a right sidewall 38, 40, a rear wall 42, and a vertically extending rail 44, as shown in FIG. 2. The front wall 36, the sidewalls 38, 40, and the rear wall 42 cooperatively form a vertically extending rectangular member and may cooperatively define an open-ended interior chamber for reducing the weight of the vertical mullion 24. The sidewalls 38, 40 include a set of holes or slots for receiving fasteners of the shear block 28 therein. The rear wall 42 includes a set of contours 46*a,b* or recesses each configured to receive a tab of the vertical removable cover (described below) therein. The walls 36, 38, 40, and 42 of the vertical mullion 24 have a thickness of approximately 0.03 inches to approximately 0.25 inches, the front wall 36 has a width of approximately 0.5 inches to approximately 5 inches, and the side walls 38, 40 have a depth of approximately 2 inches to approximately 12 inches. The walls 36, 38, 40, and 42 may also be any other suitable size and shape. The vertically extending rail 44 extends from the rear wall 42 and includes holes, grooves, or slots configured to receive connecting fasteners of the window strut 14*a* and the gaskets 16, 18 therein.

The horizontal mullion 26 (also sometimes conventionally referred to as a "transom") is provided for adding structural rigidity and for giving aesthetic shape to the curtain wall system 10 and may be positioned between the windows 12*b,c*, as shown in FIG. 1. The horizontal mullion 26 may be formed of extruded aluminum or other suitable material such as steel or composite and has a width of approximately 24 inches or any other suitable width. The horizontal mullion 26 includes a front wall 48, a top wall 50, a bottom wall 52, a rear wall 54, and a horizontally extending rail 56, as shown in FIG. 3. The front wall 48, the top wall 50, the bottom wall 52, and the rear wall 54 cooperatively form a horizontally extending rectangular member and may cooperatively define an open-ended interior chamber for reducing the weight of the horizontal mullion 26. The rear wall 54 includes a set of contours 58*a,b* or recesses each configured to receive a tab of the horizontal removable cover (described below) therein. The walls 48, 50, 52, and 54 of the horizontal mullion 26 have a thickness of approximately 0.03 inches to approximately 0.25 inches, the front wall 36 has a height of approximately 0.5 inches to approximately 5 inches, and the top and bottom walls 50, 52 have a depth of approximately 2 inches to approximately 12 inches. The walls 48, 50, 52, and 54 may also be any other suitable size and shape. The horizontally extending rail 56 extends from the rear wall 54 and includes holes, grooves, or slots configured to receive connecting fasteners of the window strut 14*b* and the gaskets 20, 22 therein.

The shear block 28 is provided for connecting the horizontal mullion 26 to the vertical mullion 26 and may be configured to be inserted into an end of the open-ended interior chamber of the horizontal mullion 26, as shown in FIG. 1. The shear block 28 includes a set of fasteners configured to be inserted into the holes or slots of the vertical mullion 26. Alternatively, the shear block 28 may include a set of holes for receiving fasteners of the vertical mullion 24.

The removable covers of the present invention fit over the mullions to provide an aesthetic design to the curtain wall system 10 and are now described in detail.

Figure 4:
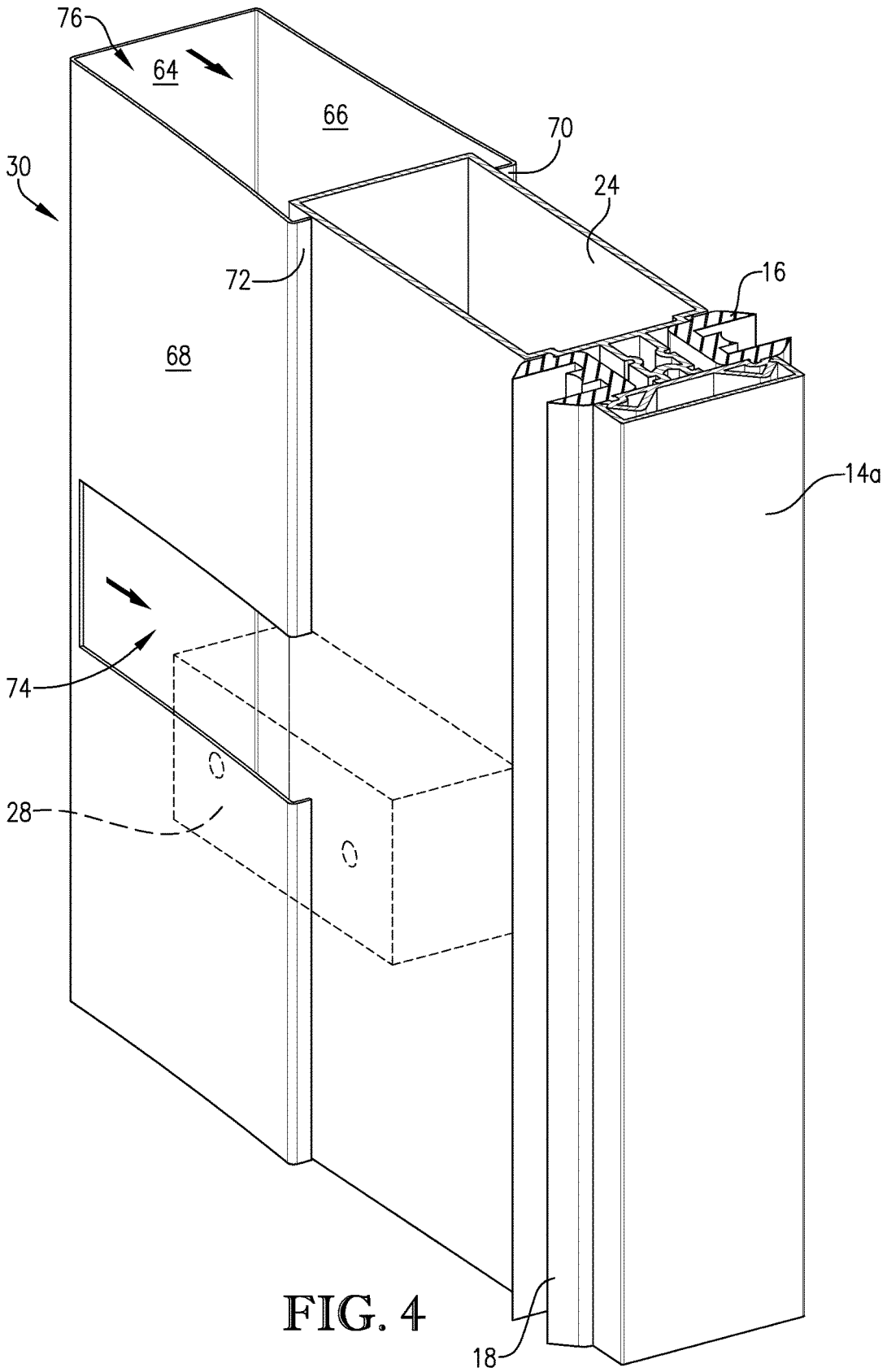
FIG. 4 is a perspective view of a vertical removable cover overlaying the vertical mullion of FIG. 2.

One embodiment of the present invention includes a vertical removable cover 60 provided for overlaying the vertical mullion 24, as shown in FIGS. 1 and 4. The vertical removable cover 60 may be formed of zinc, copper, steel, stainless steel, brass, bronze, titanium, etched aluminum, plated metal, coated metal, or any other suitable material and includes a front wall 62, a left and a right side wall 64, 66, and connecting mechanisms such as left and right tabs 68, 70. The vertical removable cover 60 may be approximately 0.5 inches to approximately 5 inches wide, approximately 2 inches to approximately 12 inches deep, and approximately 24 inches tall or any other suitable dimensions for covering the vertical mullion 24. The dimensions of the vertical removable cover 60 may be produced digitally to effect low tolerances in the cover shape.

The front wall 62 of the vertical removable cover 60 provides aesthetics to the curtain wall 10 and may include an ornamental design (FIG. 1) or may be shaped, colored, etched, raised, pressed, or milled as desired. For example, the front wall 62 may have a convex outer surface (FIG. 5) or may have design reliefs created by a chemical etching process. The left and right side walls 64, 66 extend towards a rear side of the vertical removable cover 60 and may be substantially flat or may have additional ornamental designs, shapes, coloring, or etches. The left and right side walls 64, 66 also include an open-ended slot 72 or a set of holes for receiving fasteners of the shear block 28 therethrough.

The left and right tabs 68, 70 are provided for removably connecting the vertical removable cover 60 onto the vertical mullion 24 and extend substantially perpendicular to the left and right walls 64, 66 and towards each other (FIG. 4). The tabs 68, 70 have a length of approximately 0.25 inches to approximately 1 inch and are configured to abut the contours of the window gaskets 16, 18 and the contours 46*a,b* of the rear wall 42 of the vertical mullion 24.

Figure 5:
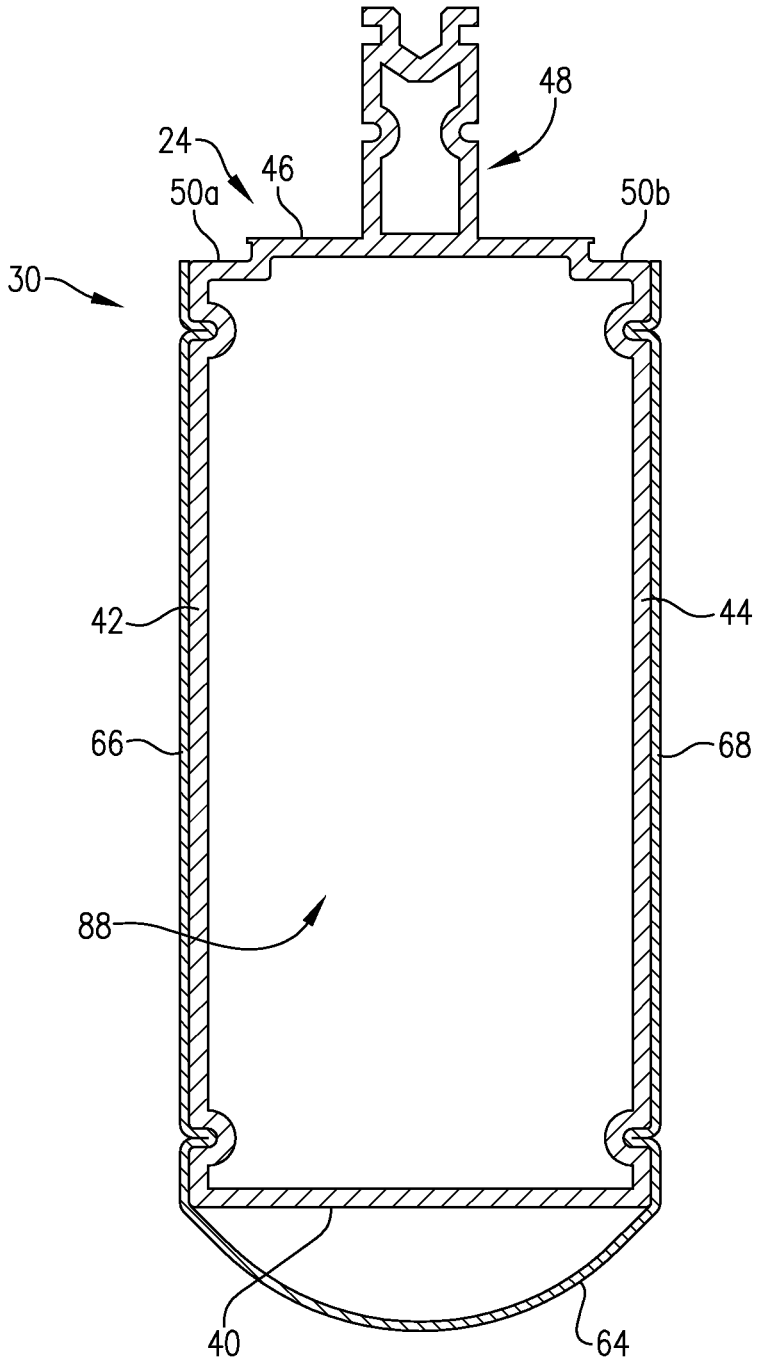
FIG. 5 is a plan view of the vertical removable cover of FIG. 4.

Another embodiment of the connecting mechanisms of the vertical removable cover 60 includes detents 76*a-d* in the left and right side walls 64, 66 of the vertical removable cover 60 that align with and fit into grooves or recesses of the vertical mullion 24, as shown in FIG. 5. The detents 76*a-d* may be folded, welded, punched, or otherwise formed into the vertical removable cover 60.

The front wall 62, the left and right side walls 64, 66, and the left and right tabs 68, 70 have a thickness of approximately 0.03 inches to approximately 0.25 inches or any other suitable dimensions and cooperatively form an interior area 74 configured receive the vertical mullion 24 therein. The front wall 62, the left and right side walls 64, 66, and the left and right tabs 68, 70 may be configured to be spaced no more than 0.1, 0.05, 0.03, or 0.01 inches from the vertical mullion 24 at any point.

Another embodiment of the vertical removable cover 60 does not include any connecting mechanisms for removably connecting the vertical removable cover 60 to the vertical mullion 24. In this case, the inside dimension of the vertical removable cover 60 measured from the inside of the left side wall 64 to the inside of the right side wall 66 may be essentially equal to or slightly smaller than the width of the vertical mullion 24 so that the vertical removable cover 60 may be friction-fitted onto the vertical mullion 24, as described below.

Yet another embodiment of the vertical removable cover 60 is removably attached to the vertical mullion 24 via fasteners such as bolts, rivets, screws, pins, hooks, clamps, or other similar fastener. The fasteners may be inserted into fastener holes in the front or sides of the vertical removable cover 60.

Figure 6:
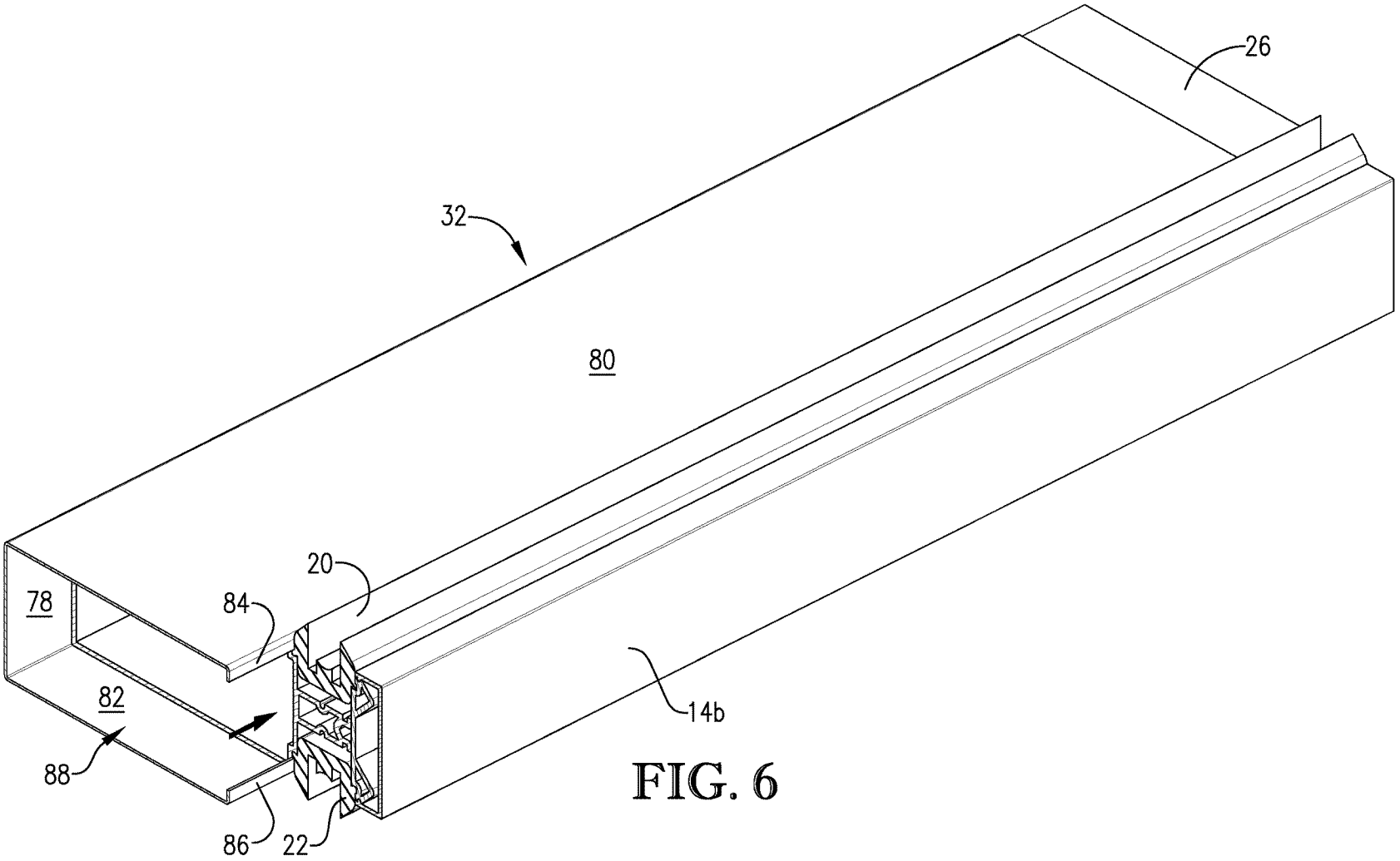
FIG. 6 is a perspective view of a horizontal removable cover overlaying the horizontal mullion of FIG. 3.

Another embodiment of the present invention includes a horizontal removable cover 78 provided for overlaying the horizontal mullion 26, as shown in FIGS. 1 and 6. The horizontal removable cover 78 may be formed of zinc, copper, steel, stainless steel, brass, bronze, titanium, etched aluminum, plated metal, coated metal, or any other suitable material and includes a front wall 80, a top wall 82, a bottom wall 84, and connecting mechanisms such as a top tab 86 and a bottom tab 88. The horizontal removable cover 78 may be approximately 0.5 inches to approximately 5 inches tall, approximately 2 inches to approximately 12 inches deep, and approximately 24 inches long or any other suitable dimensions for covering the horizontal mullion 26. The dimensions of the horizontal removable cover 78 may be produced digitally to effect low tolerances in the cover shape.

The front wall 80 of the horizontal removable cover 78 provides aesthetics to the curtain wall 10 and includes an ornamental design (FIG. 1) or may be shaped, colored, etched, raised, pressed, or milled as desired. For example, the front wall 80 may have a convex outer surface or may have design reliefs created by a chemical etching process. The top and bottom walls 82, 84 extend towards a rear side of the horizontal removable cover 78 and may be substantially flat or may have additional ornamental designs, shapes, coloring, or etches.

The top and bottom tabs 86, 88 are provided for removably connecting the horizontal removable cover 78 onto the horizontal mullion 26 and extend substantially perpendicular to the top and bottom walls 82, 84 and towards each other. The top and bottom tabs 86, 88 have a height of approximately 0.25 inches to approximately 1 inch and are configured to abut the contours of the window gaskets 20, 22 and the contours 58*a,b* of the rear wall 54 of the horizontal mullion 26.

Another embodiment of the connecting mechanisms of the horizontal removable cover 78 includes detents (similar to the detents 76*a-d* described above) in the top and bottom walls 82, 84 of the horizontal removable cover 78 that align with and fit into grooves or recesses of the horizontal mullion 24. The detents may be folded, welded, punched, or otherwise formed into the horizontal cover 78.

The front wall 80, the top and bottom walls 82, 84, and the top and bottom tabs 86, 88 have a thickness of approximately 0.03 inches to approximately 0.25 inches or any other suitable dimensions and cooperatively form an interior area 90 configured receive the horizontal mullion 26 therein. The front wall 80, the top and bottom walls 82, 84, and the top and bottom tabs 86, 88 may be configured to be spaced no more than 0.1, 0.05, 0.03, or 0.01 inches from the horizontal mullion 26 at any point.

Another embodiment of the horizontal removable cover 78 does not include any connecting mechanisms for connecting the horizontal removable cover 78 to the horizontal mullion 26. In this case, the inside dimension of the horizontal removable cover 78 measured from the inside of the top wall 82 to the inside of the bottom wall 84 may be essentially equal to or slightly smaller than the height of the horizontal mullion 26 so that the horizontal removable cover 78 may be friction-fitted onto the horizontal mullion 26, as described below.

Yet another embodiment of the horizontal removable cover 78 is removably attached to the horizontal mullion 26 via fasteners such as bolts, rivets, screws, pins, hooks, clamps, or other similar fastener. The fasteners may be inserted into fastener holes in the front or sides of the horizontal removable cover 78.

The vertical and horizontal removable covers 60, 78 may be installed onto and removed from the vertical and horizontal mullions 24, 26 and replaced or interchanged as described below.

The vertical removable cover 60 may be installed onto the vertical mullion 24 by separating the left and right tabs 68, 70 from each other far enough to fit them over the front wall 36 of the vertical mullion 24 and then pushing the vertical removable cover 60 over the vertical mullion 24 towards the window strut 14*a* (as shown in FIG. 4) until the left and right tabs 68, 70 are received over the contours 46*a,b* of the rear wall 42 of the vertical mullion 24. Alternatively, the vertical removable cover 60 may be slid over top or bottom ends of the vertical mullion 24. The vertical removable cover 60 may be removed by separating the left and right tabs 68, 70 from each other far enough to remove them from the contours 46*a,b* and then pulling the vertical removable cover 60 over the vertical mullion 24 away from the window strut 14*a*. Alternatively, the vertical removable cover 60 may be slid off the top or bottom of the vertical mullion 24. A designated tool may be used to separate the tabs 68, 70 or to slide the vertical cover 60 off of the vertical mullion 24.

In another embodiment, the vertical removable cover 60 may be installed by separating the detents 76*a-d* from each other far enough to fit them over the front wall 36 of the vertical mullion 24 and then pushing the vertical removable cover 60 over the vertical mullion 24 towards the window strut 14*a* until the detents 76*a-d* are received into the grooves or recesses of the vertical mullion 24. The vertical removable cover 60 may then be removed by separating the detents 76*a-d* from each other far enough to remove them from the grooves or recesses and then pulling the vertical removable cover 60 over the vertical mullion 24 away from the window strut 14*a*.

In yet another embodiment, the vertical removable cover 60 may be installed by sliding the left and right sidewalls 64, 66 over the vertical mullion 24 until the vertical removable cover 60 is snug against the front wall 62 of the vertical mullion 24. The tight fit of the left and right sidewalls 64, 66 retain the vertical removable cover 60 on the vertical mullion 24 by friction. The vertical removable cover 60 may then be removed by separating the left and right sidewalls 64, 66 or pulling on the vertical removable cover 60 enough to overcome the friction retaining the vertical removable cover 60 on the vertical mullion 24.

The horizontal removable cover 78 may be installed onto the horizontal mullion 26 by separating the top and bottom tabs 86, 88 from each other far enough to fit them over the front wall 80 of the horizontal mullion 26 and then pushing the horizontal removable cover 78 over the horizontal mullion 26 towards the window strut 14*b* until the top and bottom tabs 86, 88 are received over the contours 58*a,b* of the rear wall 54 of the horizontal mullion 26. Alternatively, the horizontal removable cover 78 may be slid over left or right ends of the horizontal mullion 26, as shown in FIG. 6. The horizontal removable cover 78 may be removed by separating the top and bottom tabs 86, 88 from each other far enough to remove them from the contours 58*a,b* and pulling the horizontal cover 78 over the horizontal mullion 26 away from the window strut 14*b*. Alternatively, the horizontal removable cover 78 may be slid over the left or right ends of the horizontal mullion 26. A designated tool may be used to separate the tabs 86, 88 or to slide the horizontal removable cover 78 off of the horizontal mullion 26.

In another embodiment, the horizontal removable cover 78 may be installed by separating the detents from each other far enough to fit them over the front wall 62 of the horizontal mullion 26 and then pushing the horizontal removable cover 78 over the horizontal mullion 26 towards the window strut 14*b* until the detents are received into the grooves or recesses of the horizontal mullion 26. The horizontal removable cover 78 may then be removed by separating the detents from each other far enough to remove them from the grooves or recesses and then pulling the horizontal removable cover 78 over the horizontal mullion 26 away from the window strut 14*b*.

In yet another embodiment, the horizontal removable cover 78 may be installed by sliding the top and bottom walls 82, 84 over the horizontal mullion 26 until the horizontal removable cover 78 is snug against the front wall 48 of the horizontal mullion 26. The tight fit of the top and bottom walls 82, 84 retain the horizontal removable cover 78 on the horizontal mullion 26 by friction. The horizontal removable cover 78 may then be removed by separating the top and bottom walls 82, 84 or pulling on the horizontal removable cover 78 enough to overcome the friction retaining the horizontal removable cover 78 on the horizontal mullion 26.

The above-described removable covers 60, 78 provide several advantages over conventional outer covers. For example, the vertical and horizontal removable covers 60, 78 offer more aesthetic design choices and a wider variety of design styles than conventional outer covers and mullions. The vertical and horizontal removable covers 60, 78 also present a seamless, fastener-free appearance. In addition, the vertical and horizontal removable covers 60, 78 can be quickly and easily removed, replaced and interchanged with other removable covers and do not require adhesives or fasteners.

Specifically, the vertical and horizontal removable covers 60, 78 may be bent, curved, contoured, etched, raised, pressed, milled, cut, and painted because they are not limited to being formed by extrusion. The vertical and horizontal removable covers 60, 78 may have other natural colors if formed out of other materials such as copper and brass. The contours 46*a,b*, of the vertical mullion 24 conceal the left and right tabs 68, 70 of the vertical removable cover 60 between the rear wall 42 of the vertical mullion 24, and the contours 58*a,b* of the horizontal mullion 26 conceal the top and bottom tabs 86, 88 of the horizontal cover 78 between the rear wall 54 of the horizontal mullion 26 and the window gaskets 20, 22, thus giving the vertical and horizontal covers 60, 78 a seamless and finished look. In addition, the horizontal removable cover 78 abuts a side of the vertical removable cover 60, thus resulting in a seamless and fastener-free corner look between the covers 60, 78. The vertical and horizontal removable covers 60, 78 may be removed and replaced if they are weathered, dirty, or damaged, or if a new design is desired. The vertical and horizontal removable covers 60, 78 may also be replaced with other removable covers having a different design.

Removably retaining the vertical and horizontal removable covers 60, 78 on the vertical and horizontal mullions 24, 26 via connecting mechanisms such as the tabs 68, 70, 86, 88 or the detents 76*a-d* or via a friction fit significantly reduces hardware and labor costs because connecting fasteners are not needed and because the vertical and horizontal removable covers can be quickly and easily installed, removed, and replaced. The connecting mechanisms and the friction fit also allow the removable covers 60, 78 to display more attractive fastener-free designs.

Figure 7:
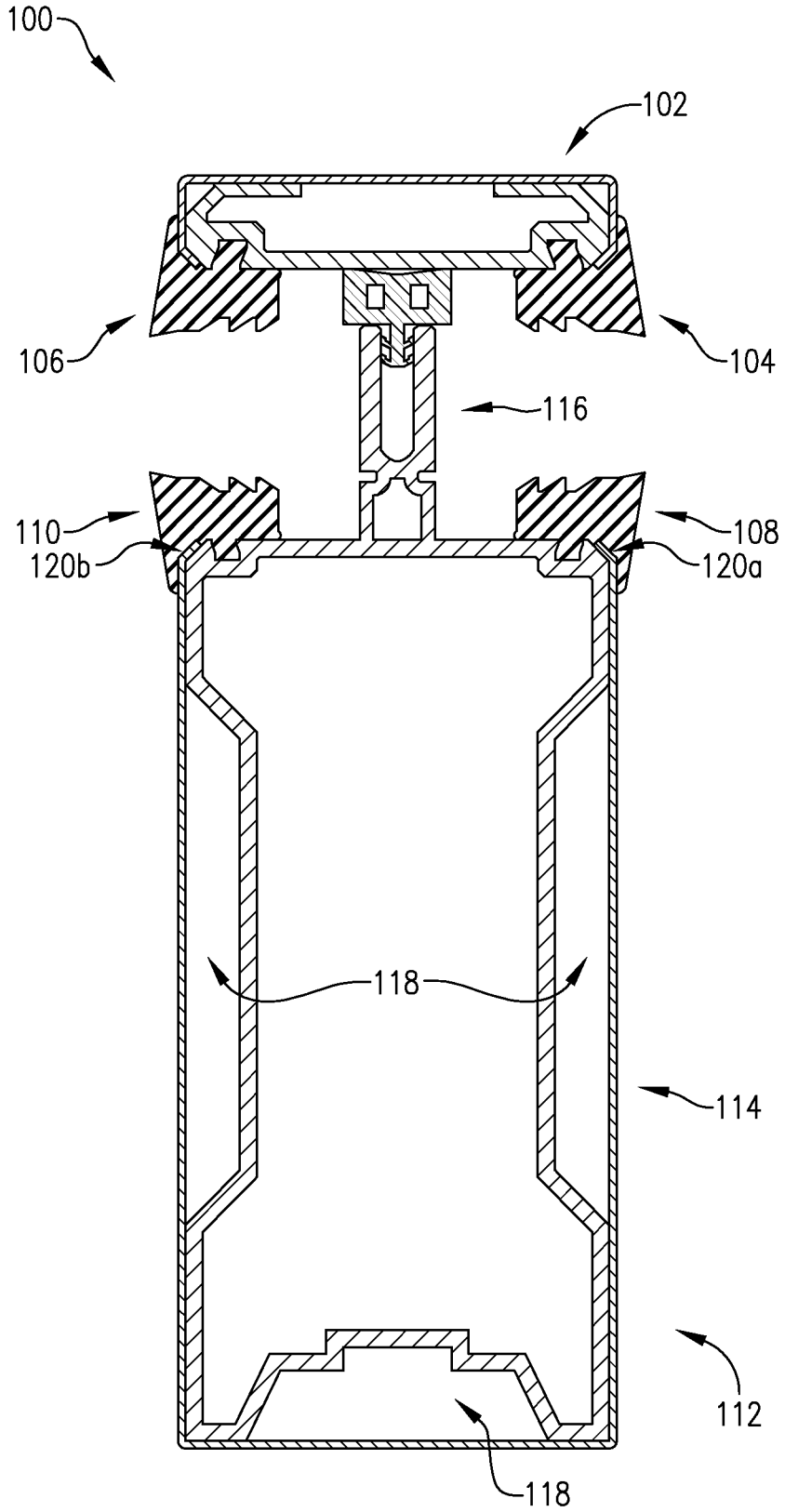
FIG. 7 is a plan view of another curtain wall system constructed in accordance with an embodiment of the present invention.

Another embodiment of the present invention is a curtain wall system 100 that includes a window strut 102, left and right rear gaskets 104, 106, left and right mullion gaskets 108, 110, a mullion 112, and a mullion cover 114, as shown in FIG. 7.

The window strut 102 provides structural integrity to the curtain wall system and may be formed of extruded aluminum or other suitable material. The window strut 102 may be positioned between edges of adjacent windows and includes fasteners for connecting the mullion 112 thereto.

The left and right rear gaskets 104, 106 are provided for forming an airtight seal between the windows and the window strut 102 and are formed of rubber, caulk, glue, or any other suitable material. The left and right rear gaskets 104, 106 abut the window strut 102 on a first side and abut a window on a second side opposite the first side. The left and right rear gaskets 104, 106 may also have a contour on the first side that wraps around a side of the window strut 102 to overlap and conceal ends of a window strut cover and to create the airtight seal between the windows and the windows strut 102.

The left and right mullion gaskets 108, 110 are provided for forming an airtight seal between the windows and the mullion 112 and are formed of rubber, caulk, glue, or any other suitable material. The left and right mullion gaskets 108, 110 abut the mullion 112 on a first side and abut a window on a second side opposite the first side. The left and right mullion gaskets 108, 110 may also have a contour on the first side that wraps around a side of the mullion 112 to overlap and conceal ends of the mullion cover 114 and to create the airtight seal between the windows and the mullion 112.

The mullion 112 is provided for adding structural rigidity and for giving aesthetic shape to the curtain wall system 100, as shown in FIG. 7. The mullion 112 may be formed of extruded aluminum or other suitable material such as steel or composite and may have dimensions similar to the mullions described above. The mullion 112 includes a front wall, left and right sidewalls, a rear wall, and a rear rail 116. The front wall and left and right sidewalls each include inwardly extending contours forming recessed spaces 118. The contours add structural rigidity mullion 112 and the recessed spaces allow electrical wiring, conduits, tubes, and fasteners to be concealed therein. The recessed spaces also allow contours of the mullion cover 114 such as decorative undulations to extend inwardly toward the mullion 112.

The mullion cover 114 is provided for overlaying the mullion 112 and may be formed of zinc, copper, steel, stainless steel, brass, bronze, titanium, etched aluminum, plated metal, coated metal, or any other suitable material. The mullion cover 114 has dimensions similar to the mullion covers described above, which may be produced digitally to effect low tolerances in the cover shape. The mullion cover 114 includes a front wall, left and right sidewalls, and left and right angled tabs 120*a,b* extending form ends of the left and right sidewalls. The front wall and left and right sidewalls may include ornamental designs and may be shaped, colored, etched, raised, pressed, or milled as desired. The left and right angled tabs 120*a,b* extend 30 degrees, 45 degrees, 60 degrees, 120 degrees, 150 degrees, or any other angle inwardly from the left and right sidewalls so as to conform to chamfered corners of the mullion 112. The left and right angled tabs 112*a,b* are kept in place against the mullion 112 and concealed by the contours of the first sides of the left and right mullion gaskets 108, 110.

The above-described mullion 112 and cover 114 provide several advantages over conventional mullions and covers. For example, the inwardly extending contours provide rigidity to the curtain wall system 100. The recessed spaces 118 allow electrical wiring, conduits, tubes, and fasteners to be concealed therein and allow contours of the mullion cover 114 such as decorative undulations to extend inwardly toward the mullion 112. In addition, the chamfered corners of the mullion 112 and the inwardly extending angled tabs 120*a,b* allow the mullion 112 to be easily removed because the chamfered corners of the mullion 112 urge the angled tabs 120*a,b* outwardly when the mullion cover 114 is pulled off of the mullion 112.

Figure 8:
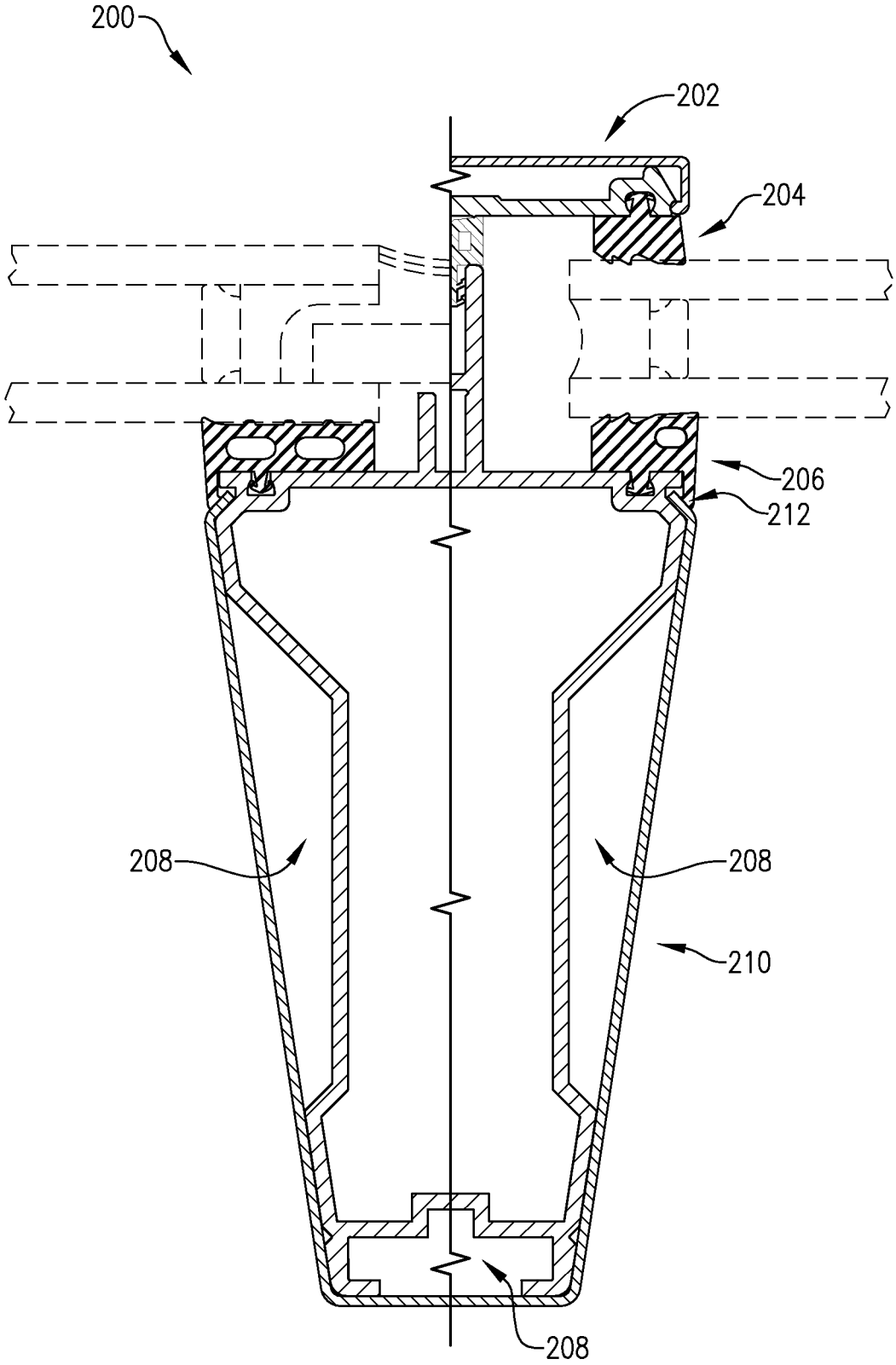
FIG. 8 is a plan view of yet another curtain wall system constructed in accordance with an embodiment of the present invention.

Another embodiment of the present invention is a curtain wall system 200 that includes a window strut 202, rear gaskets, 204, mullion gaskets 206, a mullion 208, and a mullion cover 210, as shown in FIG. 8.

The window strut 202, rear gaskets 204, and mullion gaskets 206 may be substantially similar to the corresponding components described above. For example, the rear gaskets 204 mullion gaskets 206 may be push-in preset gasket extrusions formed of dense silicone, ethylene propylene diene terpolymer (EPDM), vulcanized thermoplastic (TPV), or any other suitable material. The curtain wall assembly 200 may be assembled via toggle glazing or via a pressure cap. In the toggle glaze configuration (left side of FIG. 8), a wet seal of liquid silicone or other sealant is applied over a Teflon®, polyethylene, or other bond-breaker material on top of a computer numerical control (CNC) cut metal toggle having a dense silicone, EPDM, TPV, or other toggle cover extrusion. A thermal isolator gasket extrusion formed of dense silicone, EPDM, TPV, or other suitable material may be inserted in front of the pressure cap and behind the mullion 208. In the pressure cap configuration (right side of FIG. 8), a stainless steel, galvanized steel, or other pressure cap screw fastener is tightened over an aluminum 6063 T5 or T6 alloy or other metal extrusion snap-on beauty cap. The beauty cap is secured over an aluminum 6063 T5 or T6 alloy or other metal extrusion pressure cap. In either configuration, the windows may be spaced via a recessed insulating glass spacer formed of aluminum, stainless steel, galvanized steel, or other cold formed material filled with desiccant. The windows may then be sealed via secondary seals formed of polyisobutylene (PIB), silicone, or other suitable seal.

The mullion 208 may be similar to the mullions described above except that it may be wider at its proximal end near the window and narrower at its distal end, as shown in FIG. 8. The outer surfaces of the mullion 208 may be slanted inward from the proximal end to the distal end of the mullion 208 to form a truncated wedge shape.

The mullion cover 210 may be similar to the mullion covers described above except that the mullion cover 210 may form a truncated wedge shape that fits snugly over the outer surfaces of the mullion 208. The mullion cover 210 may have tabs 212 angled inwardly for snapping or slipping into recesses in the mullion 208. The tabs 212 may be angled greater than 90 degrees (i.e., slightly bent inwardly). The mullion cover 210 may be formed of aluminum, bronze, steel, weathering steel, or any other material as described above.

The above-described mullion 208 and mullion cover 210 provide several advantages over conventional mullions and covers. For example, the slightly inwardly bent tabs 212 allow the mullion cover 210 to be easily slid onto and pulled off of the mullion 208. In addition, the truncated wedge shape of the mullion cover 210 is relatively easy to form and allows all three sides of the mullion 208 to be seen from the front.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A removable and replaceable cover for a vertically extending mullion of a curtain wall, the removable and replaceable cover comprising:

a first sidewall and a second sidewall for abutting first and second sidewalls of the vertically extending mullion, respectively, the first and second sidewalls of the removable and replaceable cover each including opposing proximal and distal ends and at least one opening configured to receive a shear block of a horizontally extending mullion therethrough, the opening extending to the proximal end such that the removable and replaceable cover is configured to be horizontally slid onto and off of the horizontally extending mullions;

a front wall extending between the distal ends of the first and second sidewalls of the removable and replaceable cover for covering a front wall of the vertically extending mullion, the front wall of the removable and replaceable cover including an aesthetic design including an etched, raised, pressed, or milled area; and a first tab and a second tab extending from the proximal ends of the first and second sidewalls of the removable and replaceable cover, each tab being configured to abut a contour of the vertically extending mullion when the removable and replaceable cover is positioned on the vertically extending mullion and slide outwardly against the contour of the vertically extending mullion and spread the first sidewall and second sidewall of the removable and replaceable cover apart from each other until the first tab and second tab do not abut the contour of the vertically extending mullion when the removable and replaceable cover is pulled in a direction of the front wall of the removable and replaceable cover such that the removable and replaceable cover is removably connectable to the vertically extending mullion of the curtain wall.

2. The removable and replaceable cover of claim 1, wherein the removable and replaceable covet is formed of a material selected from the group consisting of zinc, copper, steel, stainless steel, brass, bronze, titanium, aluminum, plated metal, coated metal, and plastic.

3. The removable and replaceable cover of claim 1, wherein the removable and replaceable cover is formed of sheet metal.

4. The removable and replaceable cover of claim 3, wherein the removable and replaceable cover is formed from a single piece of sheet metal.

5. The removable and replaceable cover of claim 1, wherein the removable and replaceable cover is formed of molded plastic.

6. The removable and replaceable cover of claim 1, wherein the first and the second sidewall of the removable and replaceable cover each are configured to abut an end of one of the horizontally extending mullions.

7. The removable and replaceable cover of claim 1, wherein the removable and replaceable cover is interchangeable with another removable and replaceable cover having a front wall including a different aesthetic design.

8. The removable and replaceable cover of claim 1, wherein the side walls of the removable and replaceable cover include an aesthetic design.

9. The removable and replaceable cover of claim 1, wherein the front wall of the removable and replaceable cover has a convex contour.

10. A removable and replaceable cover for a vertically extending mullion of a curtain wall, the removable and replaceable cover comprising:

a first sidewall and a second sidewall extending parallel to the first sidewall for abutting first and second sidewalls of the vertically extending mullion, respectively, the first and second sidewalls of the removable and replaceable cover each including an aesthetic design, opposing proximal and distal ends, and at least one rectangular opening configured to receive a shear block of a horizontally extending mullion therethrough, the opening extending to the proximal end such that the removable and replaceable cover is configured to be horizontally slid onto and off of the horizontally extending mullions;

a front wall extending between the distal ends of the first and second sidewalls of the removable and replaceable cover for covering a front wall of the vertically extending mullion such that the first sidewall and the second sidewall of the removable and replaceable cover extend at 90 degree angles from the front wall of the removable and replaceable cover, the front wall of the removable and replaceable cover including an aesthetic design, the aesthetic design of the first and second sidewalls of the removable and replaceable cover and the aesthetic design of the front wall of the removable and replaceable cover each including an etched, raised, pressed, or milled area; and a first tab and a second tab extending from the proximal ends of the first and second sidewalls of the removable and replaceable cover, each tab being configured to abut a contour of the vertically extending mullion when the removable and replaceable cover is positioned on the vertically extending mullion and slide outwardly against the contour of the vertically extending mullion and spread the first sidewall and second sidewall of the removable and replaceable cover apart from each other until the first tab and second tab do not abut the contour of the vertically extending mullion when the removable and replaceable cover is pulled in a direction of the front wall of the removable and replaceable cover such that the removable and replaceable cover is removably connectable to the vertically extending mullion of the curtain wall, the removable and replaceable cover being formed of a material selected from the group consisting of zinc, copper, steel, stainless steel, brass, bronze, titanium, aluminum, plated metal, coated metal, and plastic, the removable and replaceable cover being further configured to revert to a pre-formed shape when the removable and replaceable cover is positioned completely over the vertically extending mullion such that the first and second tabs abut the proximal contours of the vertically extending mullion and retain the removable and replaceable cover on the vertically extending mullion.

11. The removable and replaceable cover of claim 1, wherein the opening is rectangular for receiving a rectangular shear block therethrough.

12. The removable and replaceable cover of claim 1, wherein the opening extends to ends of the tabs such that the removable and replaceable cover is configured to be horizontally slid onto and off of the horizontally extending mullions.

13. The removable and replaceable cover of claim 1, wherein the first tab and second tab extend from the first and second sidewalls of the removable and replaceable cover at air angle greater than 90 degrees.

* * * * *